US007828522B2

(12) United States Patent
Weaver

(10) Patent No.: US 7,828,522 B2
(45) Date of Patent: Nov. 9, 2010

(54) MODULAR FAN HOUSING

(75) Inventor: William C. Weaver, Carmel, IN (US)

(73) Assignee: Thomas F. Noonan, Indianapolis, IN (US)

( * ) Notice: Subject to any disclaimer, the term of this patent is extended or adjusted under 35 U.S.C. 154(b) by 714 days.

(21) Appl. No.: 11/717,933

(22) Filed: Mar. 14, 2007

(65) Prior Publication Data

US 2008/0226452 A1 Sep. 18, 2008

(51) Int. Cl.
*F03B 11/02* (2006.01)

(52) U.S. Cl. ..... 415/213.1; 415/220

(58) Field of Classification Search ..... 415/213.1, 415/220, 211.2; 454/275, 277, 309
See application file for complete search history.

(56) References Cited

U.S. PATENT DOCUMENTS

| | | | | |
|---|---|---|---|---|
| 16,010 | A | 11/1856 | Guiou | |
| 304,786 | A | 9/1884 | Butz | |
| 520,222 | A | 5/1894 | Rodin | |
| 625,451 | A | 5/1899 | Lyle | |
| 1,031,766 | A | 7/1912 | Yost | |
| 1,141,067 | A | 5/1915 | Lloyd | |
| 2,097,600 | A | 11/1937 | Pavlecka | |
| 2,106,458 | A | 1/1938 | Kurth | |
| 2,196,708 | A | 4/1940 | Reid | |
| 3,072,321 | A | 1/1963 | King, Jr. | |
| 3,625,258 | A | 12/1971 | Phelps et al. | |
| 3,765,316 | A | 10/1973 | Skoch | |
| 4,714,009 | A | 12/1987 | DeHart et al. | |
| 5,078,574 | A * | 1/1992 | Olsen | 415/182.1 |
| 5,305,797 | A | 4/1994 | Roy, Sr. | |
| 5,340,358 | A | 8/1994 | Halupczok et al. | |
| 5,609,276 | A | 3/1997 | Greatbatch | |
| 5,954,580 | A | 9/1999 | Adib et al. | |
| D496,992 | S | 10/2004 | Lafond | |
| 7,467,931 | B2 * | 12/2008 | O'Toole | 417/424.1 |
| 2003/0207666 | A1 | 11/2003 | Crook | |
| 2005/0095979 | A1 | 5/2005 | Moreno | |

* cited by examiner

*Primary Examiner*—Edward Look
*Assistant Examiner*—Dwayne J White
(74) *Attorney, Agent, or Firm*—Woodward, Emhardt, Moriarty, McNett & Henry LLP

(57) ABSTRACT

A modular fan housing unit designed to create a focused column or columns of downwardly moving air such that there is little deflection when the column or columns of downwardly moving air arrives at the ground level. The modular fan housing includes an elongated body element having a fluid impelling device to create the downwardly moving air. At least one plate disposed within the elongated body element directs the downwardly moving air into columns. The modular fan housing unit may be coupled to another modular fan housing unit to provide additional columns of downwardly moving air. The modular fan housing units may be coupled in various configurations, depending on the type of application. Furthermore, the modular fan housing unit or multiple modular fan housing units may be coupled to an elevated structure.

20 Claims, 5 Drawing Sheets

MODULAR FAN HOUSING

BACKGROUND OF THE INVENTION

Fan housing units are used in various industries to distribute, circulate, or divert fluids, such as air, propelled by a fluid impelling device. One example where fan housings are used is in the heating and cooling industry. Fan housings typically direct or circulate the flow of hot or cold air into particular rooms or areas within a building or structure. Fan housings may be coupled to a duct or a fluid impelling device. The duct may carry the air from a heating or cooling unit to an opening of the fan housing. The shape and design of the fan housing unit may either disperse the air current over a wide area or redirect the air current to another duct or fan housing unit.

One purpose of current fan housing units is to circulate air or heat or cool an area quickly and efficiently. As a result, the shape and design of current fan housing units typically do not direct the air to a centralized or focused location. To direct the air to a localized area, instead of dispersing the air over a wide area, will result the room or area to have a substantial temperature gradient. Moreover, more air and energy would be required before the room temperature is substantially uniform. To overcome some temperature gradient situations, ceiling fans may be employed, generally without any housing unit, to further disperse and mix the air over a wide area within a room. The term "ceiling fan" is used in this document in the conventional sense to refer to a fan unconnected with the ducting of any central HVAC system and adapted to be situated to move air substantially vertically within an area.

In a commercial setting, such as a department store or warehouse, the requirements may be different. For example, a commercial or industrial structure may have higher ceilings than a residential unit. Moreover, commercial settings may also include aisles or display units comprising products or goods with rows therebetween. In such a setting, dispersing the air over a wide area may not effectively circulate, heat, or cool the areas between the display units. Accordingly, one problem with conventional ceiling fans is that they do not direct the air to a focused location within a room, but rather tend to disperse the air over a wide area. Conventional ceiling fans are not designed to produce a sufficient column of air that will remain focused on a localized area as the air approaches the ground level.

Accordingly, there is a need to provide a fan with a housing unit that is capable of providing a column of air in localized areas. Additionally, there is further a need for a fan housing unit that, when coupled to a structure substantially above the ground level, is capable of providing a column of air that remains substantially localized as the column approaches the ground level. Additionally, there is further a need for a fan housing unit that is modular so that, when coupled to similar modular fan housing units, can deliver an enhanced column of air that remains substantially localized as the column approaches the ground level.

SUMMARY

In one embodiment, a housing unit for displacing fluid substantially along a single direction includes an elongated body element having a first end and a second end defining an aperture therethrough along a vertical axis. A flange is disposed within the elongated body element and is perpendicular to the vertical axis. A mounting bracket is disposed adjacent to the first end of the body element, and is operative to couple with a fluid impelling device. Also disposed within the elongated body element is at least one plate that is substantially perpendicular to the flange and creates a column of downwardly moving fluid below the second end of the elongated body element.

In another embodiment, a housing unit includes a fluid impelling device and an elongated body element having a first end and a second end defining an aperture therethrough along a vertical axis. A mounting bracket is disposed adjacent to the first end of the body element, where the mounting bracket is operatively coupled to the fluid impelling device. A flange is disposed within the elongated body element and is perpendicular to the vertical axis. The flange further defines an opening that permits the fluid impelling device to displace fluid towards the second end of the elongated body element. At least one plate is disposed within the elongated body element and is substantially perpendicular to the flange, which creates a column of downwardly moving fluid below the second end of the body element.

The various embodiments provide significant advantages over other modular fan housing units. For example, and without limitation, the ability of the modular fan housing unit to provide a column of air to localized areas at ground level is one significant advantage over other modular fan housing units. Furthermore, the modular fan housing unit is capable of providing this localized column of air when coupled to a structure substantially above ground level. The modular fan housing units are also capable of being coupled to similar modular fan housing units, and will provide an enhanced column of air that remains substantially localized as the column approaches the ground level.

The foregoing paragraphs have been provided by way of a general introduction, and are not intended to limit the scope of the following claims. The various embodiments, together with further advantages, will be best understood by reference to the following detailed description taken in conjunction with the accompanying drawings.

DETAILED DESCRIPTION OF PREFERRED EMBODIMENTS

The following detailed description and appended drawings describe and illustrate various exemplary embodiments of the invention. The description and drawings serve to enable one skilled in the art to make and use the invention, and are not intended to limit the scope of the invention in any manner.

The disclosed embodiments relate to a modular fan housing unit 10 that is capable of creating a column of air that is very focused in direction and is capable of maintaining a focused column of air to the ground level, even if the modular fan housing unit 10 is coupled to a structure substantially above the ground level. As used herein, the term "coupled" means directly connected to or indirectly connected through one or more intermediate components, including but not limited to the structure of the modular fan housing unit 10.

Figure 1:
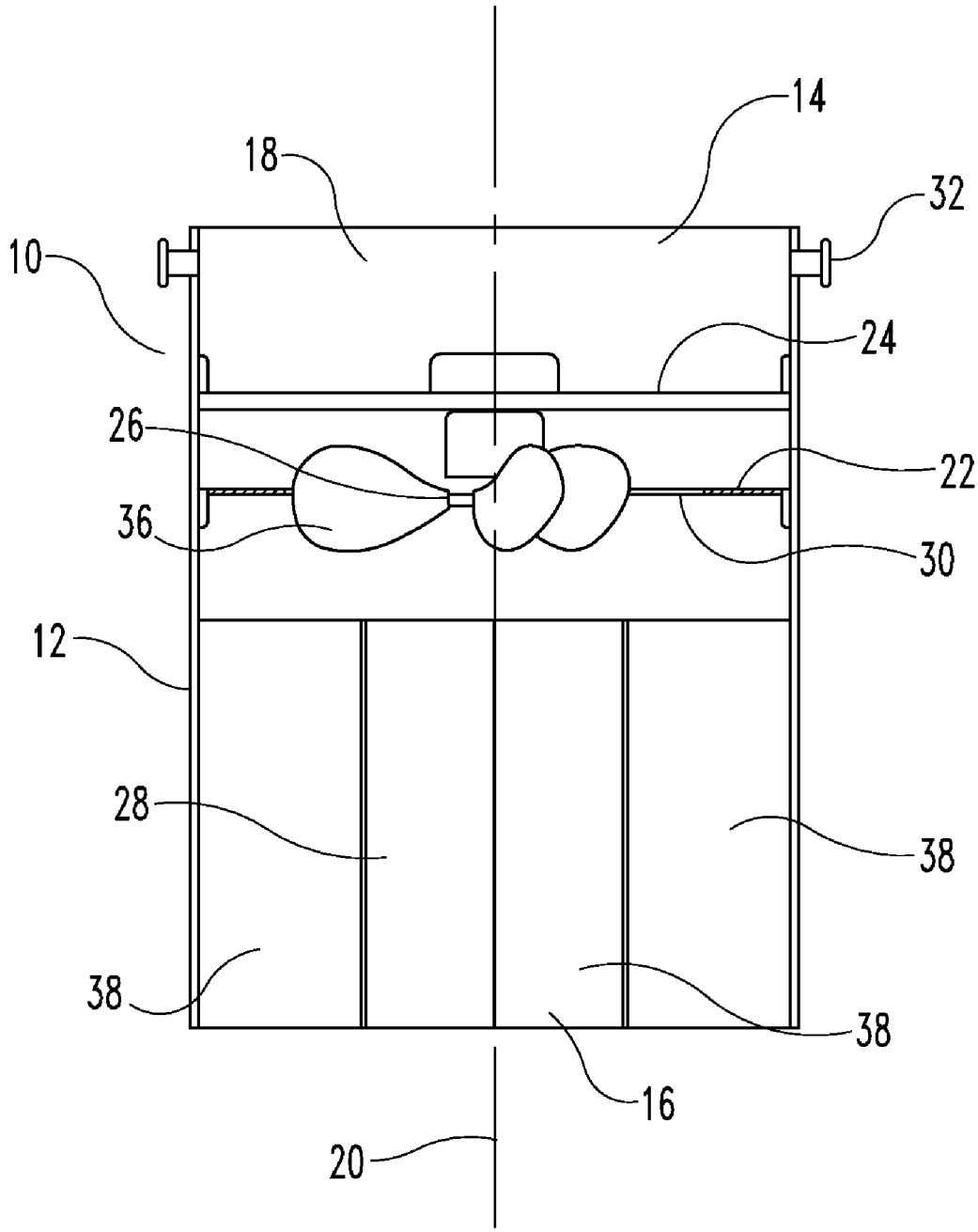
FIG. 1 is a perspective view of a modular fan housing unit.
Figure 2:
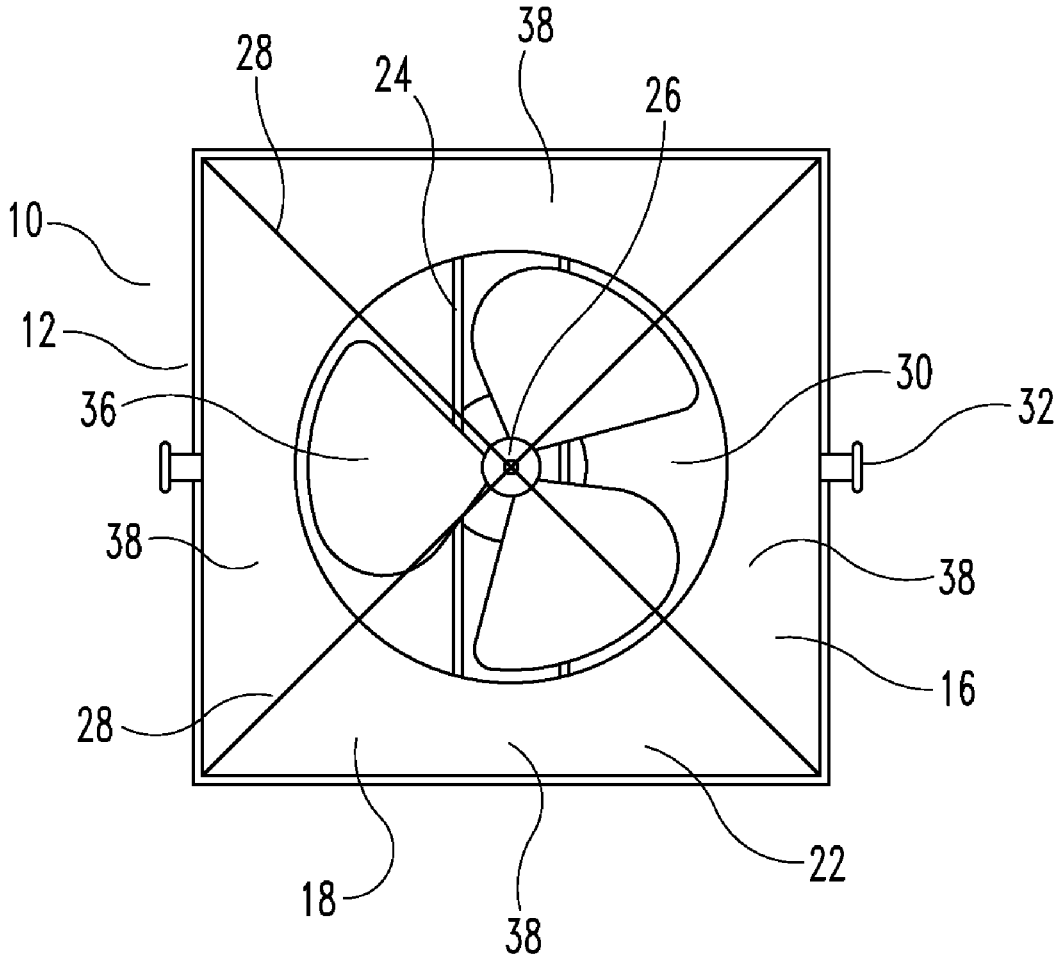
FIG. 2 is a bottom perspective view of the modular fan housing unit of FIG. 1.
Figure 3:
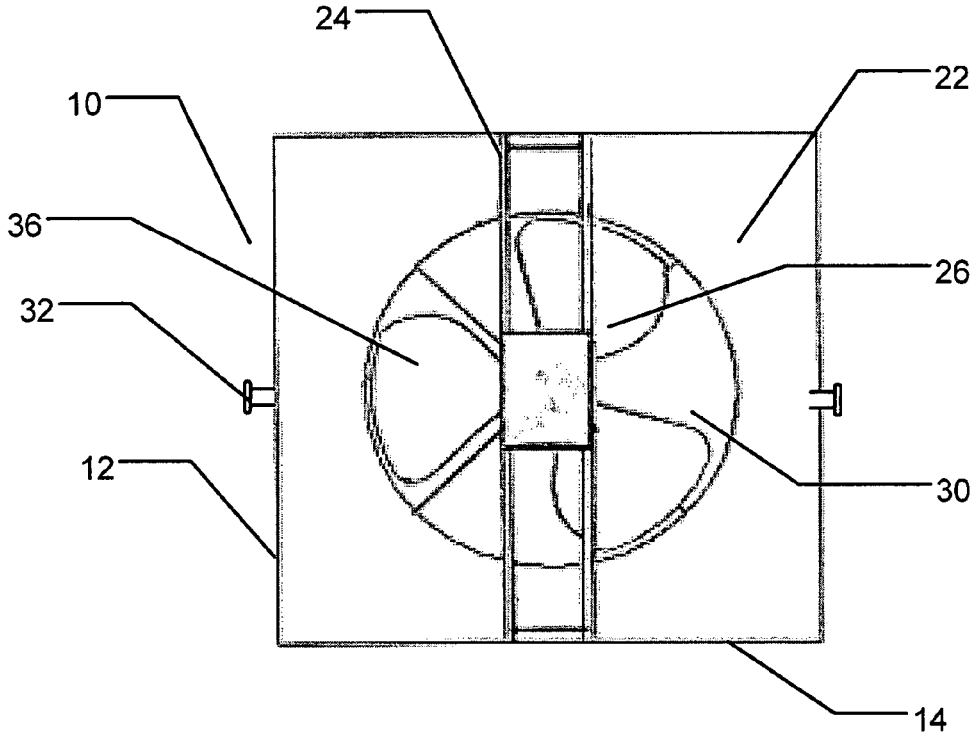
FIG. 3 is a top perspective view of the modular fan housing unit of FIG. 1.

Turning now to the drawings, FIGS. 1, 2, and 3 illustrate a modular fan housing unit 10, according to one embodiment, comprising an elongated body element 12 having a first end 14 and a second end 16 defining an aperture 18 therethrough. The housing unit 10 is defined by a vertical axis 20 that extends from the first end 14 through the second end 16 of the elongated body element 12. It can be appreciated that the elongated body element 12 may have a circular shape, oblong shape, rectangular shape, pyramidal shape, or a combination thereof. In the embodiment illustrated in FIGS. 1-3, elongated body element 12 has a substantially square shape when viewed along the vertical axis. Disposed between the first 14 and second 16 ends of the elongated body element 12 is a fluid impelling device 26. The fluid impelling device 26 may consist of one or more blades 36 and may be motorized or manually actuated. Alternatively, the fluid impelling device 26 may consist of a jet-like turbine having blades 36 internally disposed within the housing of the fluid impelling device 26. It can be appreciated that the modular fan housing unit 10 may be coupled with a duct, vent, or a structure capable of transporting air. Coupled to the fluid impelling device 26 is a mounting bracket 24. As shown in FIGS. 1 and 3, the mounting bracket 24 is coupled with the elongated body element 12 and is disposed between the fluid impelling device 26 and the first end 14 of the elongated body element 12. Alternatively, the mounting bracket 24 may be located below the fluid impelling device 26. Disposed between the first 14 and second 16 ends of the elongated body element 12 is a flange 22 having an opening 30 that is designed to allow the column of air produced by the fluid impelling device 26 to pass therethrough. As shown in FIG. 1, flange 22 consists essentially of a thin sheet. The flange 22 is substantially perpendicular to the vertical axis 20 and, as shown in FIG. 2, the opening 30 of the flange 22 is circular in shape. However, it can be appreciated that the opening 30 may take the form of other shapes, such as, but not limited to, elliptical, oval, or rectangular. The opening 30 of the flange 22 may be sufficient to allow the blades 36 of the fluid impelling device 26 to at least partially pass therethrough, as shown in FIG. 1. However, the flange 22 may be adjustable with respect to the elongated body element 12 and therefore the flange 22 may be moved relative to the fluid impelling device 26. In the embodiment illustrated in FIG. 1, flange 22 is positioned with respect to fluid impelling device 26 so that blades 36 are longitudinally positioned within opening 30. To allow the flange 22 to be adjusted with respect to the fluid impelling device 26, the flange may be slidably engaged to a slot (not shown) or a series of slots (not shown) along the elongated body element 12.

Disposed between the flange 22 and the second end 16 of the elongated body element 12 is at least one plate 28. The plate 28 is substantially perpendicular to the flange 22. In one preferred embodiment, as shown in FIG. 1, the modular fan housing unit 10 has two plates 28 that intersect each other along the vertical axis 20. As illustrated in FIG. 1, plates 28 extends from proximate blades 36 (and flange 22) to proximate second end 16 within elongated body element 12. The plates 28 may be completely disposed within the elongated body element 12 and may be coupled to the elongated body element 12 along its corners, as shown in FIG. 2, or anywhere therebetween. It can be appreciated that more than two plates 28 may be disposed within the elongated body element 12. Moreover, the plates 28 need not intersect each other along the vertical axis 20. The plates 28 may, for example, intersect each other at an axis parallel to the vertical axis 20, or not intersect at all. Furthermore, the plates 28 may be of different lengths, widths, and thicknesses and may not extend to the second end 16 of the elongated body element 12. As illustrated in FIGS. 1 and 2, plates 28 subdivide the cross sectional area of elongated body element 12 into four elongated ducts 38.

Figure 4:
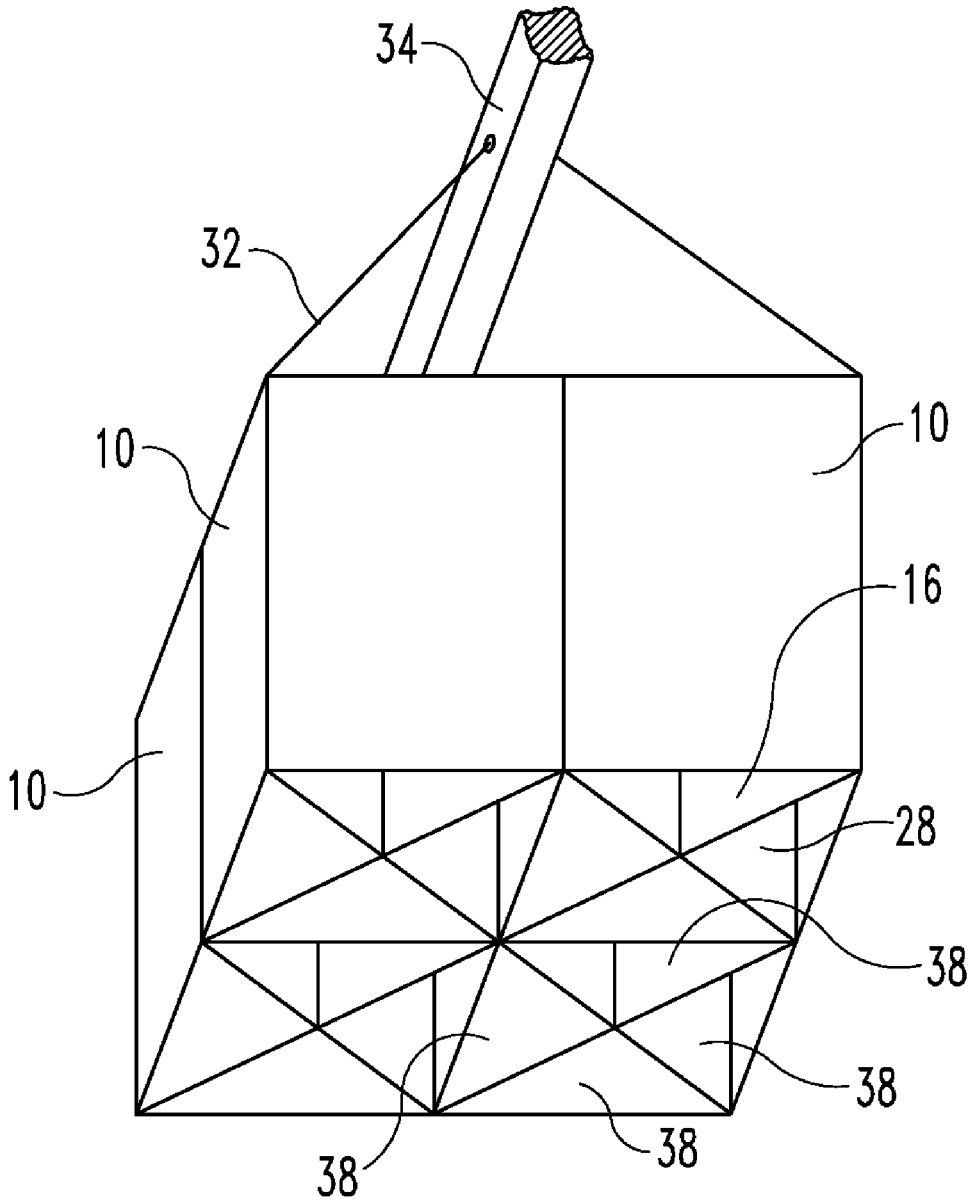
FIG. 4 is a perspective view of multiple fan housing units coupled together in one embodiment.
Figure 5:
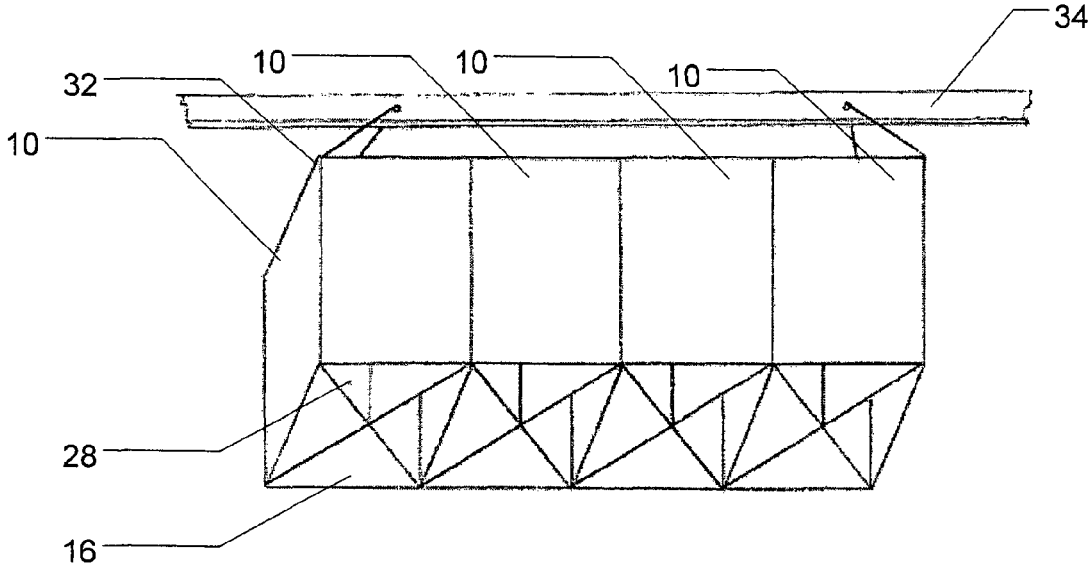
FIG. 5 is a perspective view of multiple fan housing units coupled together in another embodiment.

As illustrated in FIGS. 1, 2, and 3, coupled to the first end 14 of the elongated body element 12 is a fastener 32. The fastener 32 is designed to couple the elongated body element 12 to an elevated structure 34, such as a ceiling truss or I-beam, as shown in FIGS. 4 and 5. More than one fastener 32 may be coupled to either side of the housing unit 10, depending on the size and weight of the housing unit 10 and configuration of the elevated structure 34. The fastener 32 may be comprised of an eye-hook, latch mechanism, snap locks, brackets, nut and bolt configuration, or a combination thereof. Alternatively, it can be appreciated that the elongated body element 12 may be coupled to the elevated structure 34 by simply looping a chain or a cord through an aperture (not shown) on each side of the first end 14 of the elongated body element 12.

As shown in FIG. 4, the housing units 10 are modular so that more than one housing unit 10 may be coupled together on multiple sides. The fasteners 32 used to couple the housing units 10 may comprise of an eye-hook, latch mechanism, snap locks, brackets, nut and bolt configuration, or a combination thereof. An alternative configuration is shown in FIG. 5, where the housing units 10 are coupled in a stacked configuration. It can be appreciated that the housing units 10 may be coupled together in a variety of configurations and may be application dependent.

In operation, the fluid impelling device 26 of the housing unit 10 creates a column of air moving towards the second end 16 of the elongated body element 12. The column of air is confined to the dimensions of the aperture 18 defined by the elongated body element 12 and is prevented from traveling towards the first end 14 of the elongated body element 12 by the flange 22. The column of air is directed between the plates 28 that are disposed within the elongated body element 12, thereby creating a more focused column of air with a width substantially equal to the opening of the second end 16 of the elongated body element 12. Once the column or columns of air move beyond the second end 16 of the elongated body element 12, the focused column or columns of air travel towards the ground level of the structure without major deflection. For example, if the housing unit 10 is coupled to an elevated structure 34 in a 25 to 40 foot ceiling arrangement, the column of air will only spread approximately two to four times the width of the second end 16 of the elongated body element 12 once the column of air reaches the ground level. As previously discussed, the housing units 10 may be coupled together to create a larger column of moving air without major deflection at the ground level. Alternatively, the column or columns of air produced by the housing units 10 may also be directed to areas other than the ground level.

While the invention has been illustrated and described in detail in the drawings and foregoing description, the same is to be considered as illustrative and not restrictive in character, it being understood that only exemplary embodiments have been shown and described and do not limit the scope of the invention in any manner. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

I claim:

1. A housing unit for displacing fluid substantially along a single direction, the housing unit comprising:

an elongated body element having a first end and a second end defining an aperture therethrough along a vertical axis and wherein the elongated body element has a substantially square shape when viewed along the vertical axis;

a flange comprising a thin sheet, wherein the flange is disposed within the elongated body element perpendicular to the vertical axis and wherein the flange defines an opening laterally centered within the elongated body element;

a mounting bracket disposed adjacent to the first end of the body element, the mounting bracket operative to couple with a fluid impelling device that includes a blade, wherein the mounting bracket is positioned so that, when the fluid impelling device is coupled to the mounting bracket, the blade is longitudinally positioned within the opening; and at least two plates disposed within the elongated body element and substantially perpendicular to the flange, wherein the at least two plates extends toward the second end from proximate the flange, wherein the at least two plates extend to the corners of the substantially square shaped elongated body element and wherein the two plates subdivide the cross sectional area of the elongated body as viewed along the vertical axis into four elongated ducts to create a column of downwardly moving fluid below the second end of the elongated body element.

2. The housing unit of claim 1, wherein the location of the flange is adjustable with respect to the elongated body element.

3. The housing unit of claim 1, wherein the at least two plates intersect each other.

4. The housing unit of claim 3, wherein the at least two plates intersect each other substantially along the vertical axis.

5. The housing unit of claim 1, wherein the housing unit further comprises a fastener operative to be coupled with an elevated structure.

6. The housing unit of claim 5, wherein the housing unit further comprises at least two housing units coupled together to create a larger column or channels of downwardly moving fluid.

7. The housing unit of claim 1, wherein the at least two plates extends longitudinally within the elongated body element substantially to the second end.

8. A fluid impelling device and a housing unit therefore, comprising:

an elongated body element having a first end and a second end defining an aperture therethrough along a vertical axis;

a mounting bracket disposed adjacent to the first end of the body element, the mounting operatively coupled to the fluid impelling device;

a flange disposed within the elongated body element perpendicular to the vertical axis wherein the flange further defines an opening permitting the fluid impelling device to displace fluid towards the second end of the elongated body element; and at least two plates disposed within the elongated body element and substantially perpendicular to the flange to create a column of downwardly moving fluid below the second end of the body element, wherein the at least two plates are disposed substantially along the length of the elongated body between proximate the flange and proximate the second end, wherein the elongated body element has a substantially square shape when viewed along the vertical axis, wherein the at least two plates extend to the corners of the substantially square shaped elongated body element and wherein the two plates subdivide the cross sectional area of the elongated body as viewed along the vertical axis into four elongated ducts.

9. The fluid impelling device and the housing unit therefore of claim 8, wherein the location of the flange is adjustable with respect to the elongated body element.

10. The fluid impelling device and the housing unit therefore of Claim 8, wherein the at least two plates intersect each other.

11. The fluid impelling device and the housing unit therefore of claim 10, wherein the at least two plates intersect each other substantially along the vertical axis.

12. The fluid impelling device and the housing unit therefore of claim 8, wherein the housing unit further comprises a fastener operative to be coupled with an elevated structure.

13. The fluid impelling device and the housing therefore of claim 12, wherein the housing unit further comprises at least two housing units coupled together to create a larger column or channels of downwardly moving fluid.

14. The fluid impelling device and the housing unit therefore of Claim 8, wherein the at least two plates subdivide the cross sectional area of the elongated body as viewed along the vertical axis into four elongated ducts.

15. The fluid impelling device and the housing unit therefore of claim 8, wherein the flange consists essentially of a thin sheet.

16. A ceiling fan comprising:

an elongated body element having an upper end and a lower end defining an aperture therethrough along a vertical axis, wherein the elongated body element has a substantially square shape when viewed along the vertical axis;

a mounting bracket disposed adjacent to the upper end of the body element, and a fluid impelling device operatively coupled to the mounting bracket;

a flange disposed within the elongated body element perpendicular to the vertical axis, the flange further defining an opening laterally centered within the elongated body element permitting the fluid impelling device to displace fluid towards the lower end of the elongated body element, wherein the fluid impelling device is positioned within the opening; and two intersecting plates disposed within the elongated body element and substantially perpendicular to the flange, wherein the two intersecting plates extend toward the lower end from proximate the fluid impelling device to proximate the lower end and wherein the two intersecting plates subdivide the cross sectional area of the elongated body as viewed along the vertical axis into four elongated ducts to create a column of downwardly moving fluid below the lower end of the body element.

17. The ceiling fan of claim 16, wherein the ceiling fan is constructed and arranged to permit multiple ceiling fans to be coupled together to create a larger column or channels of downwardly moving fluid.

18. The ceiling fan of claim 16, wherein the location of the flange is adjustable with respect to the elongated body element.

19. The ceiling fan of claim 16, wherein the flange consists essentially of a thin sheet.

20. The ceiling fan of claim 16, wherein the two intersecting plates intersect substantially along the vertical axis and extend to the corners of the substantially square shaped elongated body element.

* * * * *